US006116567A

United States Patent [19]

Brasil

[11] Patent Number: 6,116,567

[45] Date of Patent: Sep. 12, 2000

[54] MODULAR TRUSS SHORING SYSTEM

[75] Inventor: John G. Brasil, Mississauga, Canada

[73] Assignee: Etobicoke Ironworks Ltd, Canada

[21] Appl. No.: 09/057,226

[22] Filed: Apr. 8, 1998

[30] Foreign Application Priority Data

Aug. 14, 1997 [CA] Canada ..... 2213072

[51] Int. Cl.[7] ..... E04G 11/54

[52] U.S. Cl. ..... 249/18; 52/126.6

[58] Field of Search ..... 249/18, 28, 188; 52/126.1, 126.5, 126.6, 645, 646

[56] References Cited

U.S. PATENT DOCUMENTS

| | | | |
|---|---|---|---|
| 4,077,172 | 3/1978 | Johnston | 249/18 |
| 4,156,999 | 6/1979 | Avery | 52/737.6 |
| 4,492,358 | 1/1985 | Manderla | 249/18 |
| 4,585,204 | 4/1986 | Parker et al. | 249/28 |

*Primary Examiner*—Michael Safavi
*Attorney, Agent, or Firm*—Anthony J. Casella; Gerald E. Hespos; Michael J. Porco

[57] ABSTRACT

A modular truss shoring system for forming concrete barriers in situ has truss members formed of upper and lower chord members are connected by diagonal struts. The struts being adjustable between chords to thereby allow for variation of height between the upper and lower chord. Tube truss legs are attached to and extend between the upper and lower chord with extension legs passing through the tube truss legs. The extension legs being adjustable with respect to the tube truss legs so as to allow for overall height adjustment of the truss members. Screw jacks are provided at the base of the extension legs allowing for adjustment of the truss members elevation with respect to a bearing surface. Cross bracing members are provided between adjacent truss members to stabilize the truss shoring system.

4 Claims, 5 Drawing Sheets

MODULAR TRUSS SHORING SYSTEM

FIELD OF THE INVENTION

The present invention relates to modular truss shoring systems for forming concrete in situ. The invention teaches a novel apparatus and method to provide a multitude of physical size requirements of modular truss shoring systems while satisfying the productivity, dependability, and safety features that the construction industry seeks in such systems.

BACKGROUND OF INVENTION

With the increase in forming concrete, in situ, for ceilings and floors in the construction of buildings, there has been an increase in the variety of modular truss shoring systems commercially available. Once such truss shoring system is taught in Canadian Patent No. 1,242,591. Patent No. '1591 teaches a truss system to overcome a common problem encountered by traditional flying forms, namely, effective heights of flying forms being incompatible with a growing architectural trend for reduced clear area between concrete sills and downwardly extending ceiling edges.

The traditional effective height of the truss shoring system is the extent to which the legs may extend below the truss, the height of the truss and the height of any "packing" material secured above the truss. Current truss shoring systems have an intermediate truss with extendable legs associated therewith. Certain of the legs are associated with the truss to extend below the truss for engaging a support surface while other legs extend above the truss to engage load collecting beams. A better definition of effective height of the truss shoring system is the extent to which the legs may extend below the truss when contracted, the height of the truss and the height of any "packing" material secured above the truss. However, there are serious limitations in the modular truss shoring system solutions currently available including that of Patent No. '591.

Once such problems in the intermediate truss is a fixed height. Currently available solutions teach having extendable legs to adapt the truss system to changing design restrictions from floor to floor of a building under construction. Although this may reduce the effective height of the overall truss system there remains the fixed height from lower chord to upper chord height of the truss.

Therefore, a modular truss system to overcome the serious need to have even greater flexibility in terms of the height of the chord to chord truss system is required.

SUMMARY OF INVENTION

Therefore is provided the apparatus for a modular truss shoring system comprising of: upper and lower chord members having a flat horizontal surface and a flat vertical surface, said vertical surface having a plurality of openings thereon; diagonal strut means having an opening at each end, said strut means diagonally connected to the upper and lower chords thereby determining the overall effective height of the system; a plurality of tube truss legs comprising of one tube, a planar surface adaptively connected to the outside of the tube extending the length of the tube having a plurality of openings thereon piercing the planar surface and extending through the tube walls, said planar surface extending past the lateral planes of the outside wall of the tube forming a mounting ledge on both sides of the tube, said mounting ledge having a plurality of openings thereon; and, extension legs inserted in the tube and axially extendable to a desired height.

There is also provided by the invention a method of selectively altering the effective height of a modular truss shoring system consisting of the following steps: connecting one end of a diagonal strut to a chord member; adjusting the angle between the connected chord member and the diagonal strut by moving the diagonal strut towards or away from the chord member; and, connecting the free end of the diagonal strut to another chord member.

BRIEF DESCRIPTION OF FIGURES

Preferred embodiments of the present invention will now be described in greater detail and will be better understood when read in conjunction with the following drawings, in which.

Similar references are used in the Figures to denote similar components.

DETAILED DESCRIPTION OF THE INVENTION

Figure 1:
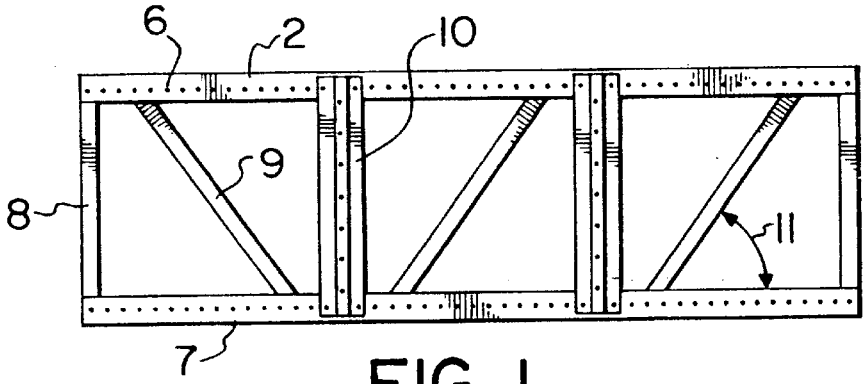
FIG. 1 is a perspective view of the modular truss shoring system.
Figure 7:
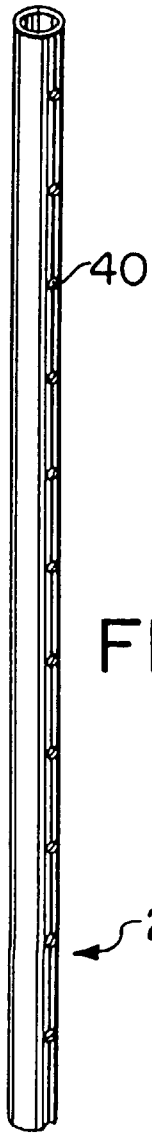
FIG. 7 is a perspective view of the extension legs.
Figure 8:
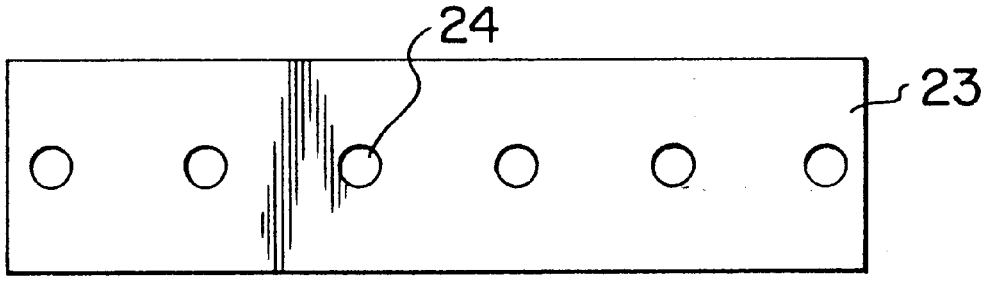
FIG. 8 is a side view of the splice angle.
Figure 9:
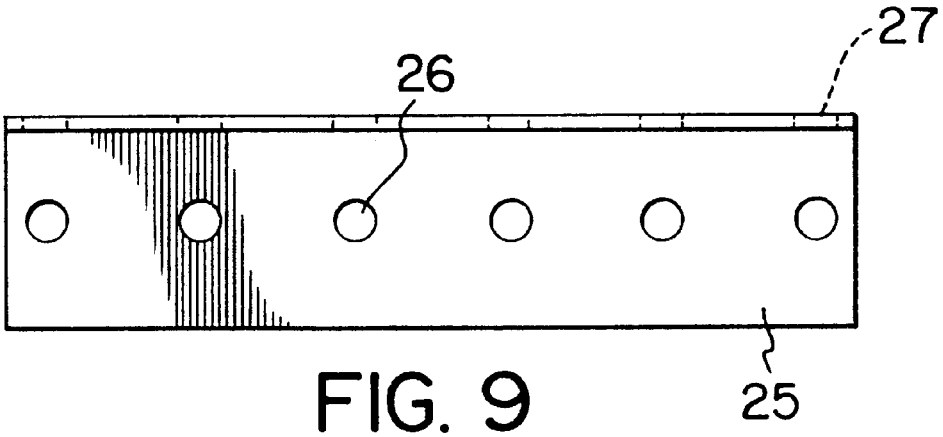
FIG. 9 is a side view of the splice plate.

With reference to FIG. 1, a side view of the preferred embodiment of the modular truss system is shown. The system includes upper chord 2, lower chord 7, single tube truss legs 10, extension legs 21 (shown in FIGS. 7,11), diagonal struts 9, and vertical struts 8.

Figure 2:
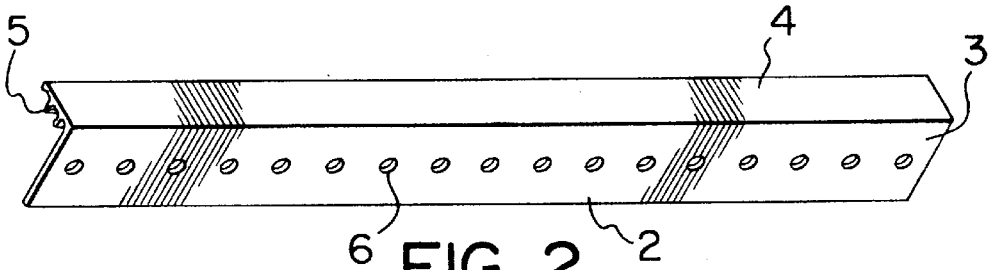
FIG. 2 is a perspective view of the upper/bottom chord.
Figure 10:
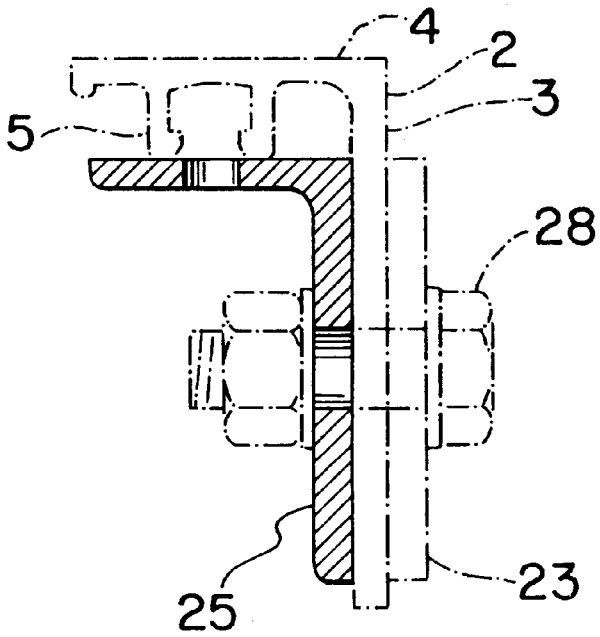
FIG. 10 is a partial cross sectional view of the upper chord, splice angle and splice plate secured together by a nut and bolt set.

With reference to FIG. 2, a preferred embodiment of upper and lower chords members 2,7 is shown. A description of upper chord 2 follows; however, the description would equally apply to lower chord 7. Chord 2 has a flat horizontal surface 4 and a perpendicular vertical surface 3. Advantageously, a series of openings 6 are provided along the length of the surface 3 piercing the width thereof. Along the underside of horizontal surface 4 runs two parallel outwardly extending protrusions 5 having along its length innerwardly facing ends 29 (shown in FIG. 10). Protrusions 5 provide support for splice angle 25 as shown in FIG. 10. In operation, splice angle 25 abuts the inner surface of vertical surface 3; rests against protrusions 5; and the opening 26 of splice angle 25 is aligned with openings 6 of chord 2. Furthermore, splice plate 23, in operation, abuts outward side of vertical surface 3 and is also aligned with openings 6 of chord 2, as shown in FIG. 10. Splice angle 25, splice plate 23 and chord 2 are secured together with a nut and bolt configuration 28. In the remaining free openings found along splice plate 23 and splice angle 25 other members, such as the diagonal strut 9, of the system may be secured with a similar nut and bolt configuration. Splice angle 25 and splice plate 23 support the connection of load bearing members such as the diagonal strut 9, vertical strut 8 and single tube truss legs 10 to upper and lower chords 2,7. Advantageously, splice angle 25 and splice plate 23 distribute load characteristics derived from supporting forming concrete and "packing" and assist in preventing excessive loads from damaging upper and lower chords. As such in another embodiment of the invention, it may be sufficient to have only the splice angle 25 secured to the chord member in circumstances where only diagonal strut 9 is connected to the chord member. Likewise, where the single tube truss legs 10 is to be connected to the chord member securing the splice plate 23 to the chord member may be sufficient for single tube legs 10 to be subsequently fastened thereon.

Figure 5:
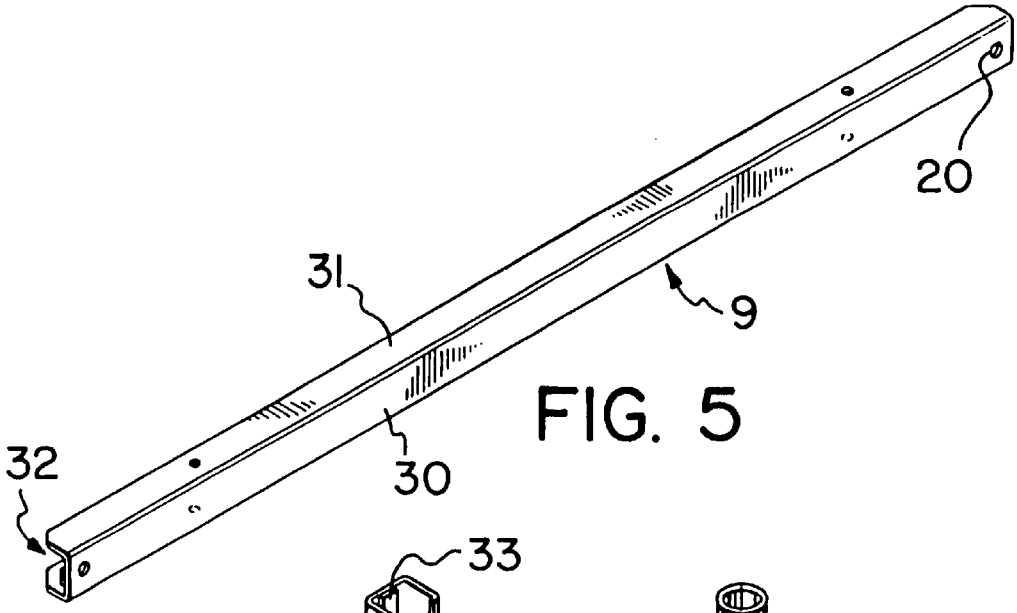
FIG. 5 is a perspective view of the diagonal strut.

Diagonal strut 9 traverses the vertical distance between upper chord 2 and lower chord 7, and connects to chords 2,7 as shown in FIG. 1. With reference to FIG. 5, diagonal strut 9 has face abutting surface 30 that is flanked along the length thereof by sides 31. Sides 31 are tapered at the corner outside ends 32. Surface 30 has openings 20 at either end. Opening 20 of diagonal strut 9 is aligned with opening 26 of secured splice angle 25 and is then secured together by outer face 30 abutting outer surface of splice angle 25 with a nut and bolt configuration 28 (not shown). A similar connection of diagonal strut 9 with lower chord 7 is accomplished.

Figure 6:
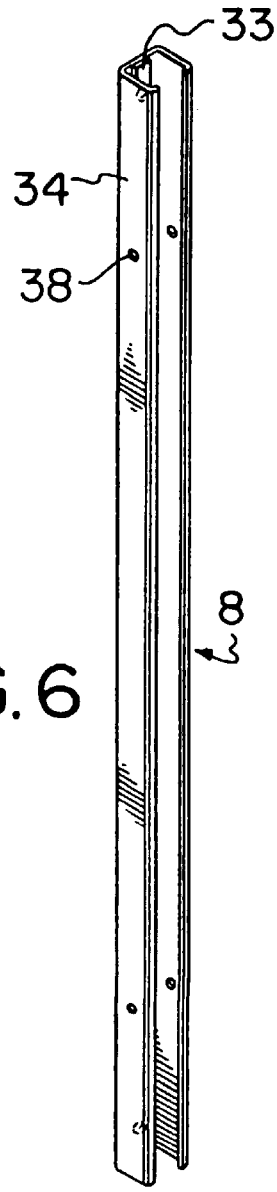
FIG. 6 is a perspective view of the vertical strut.

Vertical strut 8 is attached to upper and lower chords 2,7 as shown in FIGS. 1,2. With reference to FIG. 6, vertical strut 8 has mounting face 33 and perpendicular sides 34 flanking the length of face 33. Sides 34 have along their length inwardly facing edges. Vertical strut 8 is secured to chords 2,7 by aligning opening 38 with opening 26 of secured splice angle 25 and fastening the strut 8 with splice angle 25 with a nut and bolt configuration in a similar fashion as with diagonal strut 9 described above. In another embodiment of the invention vertical strut 8 may not be required in the truss system 1.

Figure 4:
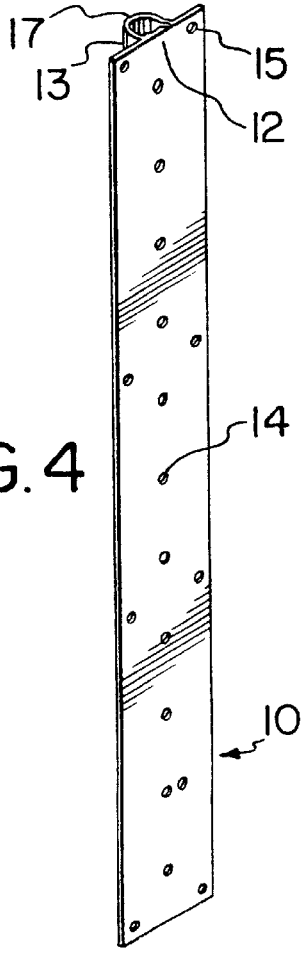
FIG. 4 is a rear perspective view of the single tube truss legs.
Figure 3:
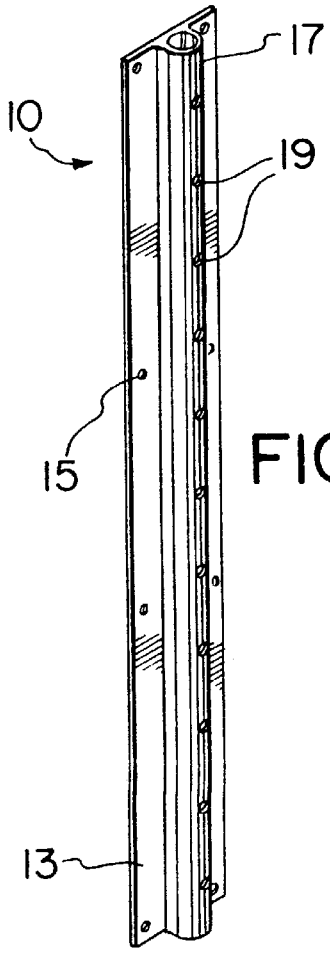
FIG. 3 is a front perspective view of the single tube truss legs.

Single tube truss leg 10, as shown in FIGS. 3,4 comprise of one hollow tube 17, a planar surface 12 adapted to the outside of the tube 17 forms a plane forming wall along the length of tube 17 having a series of opening 14 thereon. Planar surface 12 extends past the lateral planes of the outside lateral walls of tube 17 forming a mounting ledge 10 on both sides of tube 17, said mounting ledge 10 having a plurality of openings 15 that extend through the width thereof. The single tube truss leg 10 is secured to the upper and lower chords 2,7 by fastening a nut and bolt configuration through the aligned opening 15 with openings 24 of the splice plate 23 in a similar fashion as with diagonal strut 9 described above.

Figure 12:
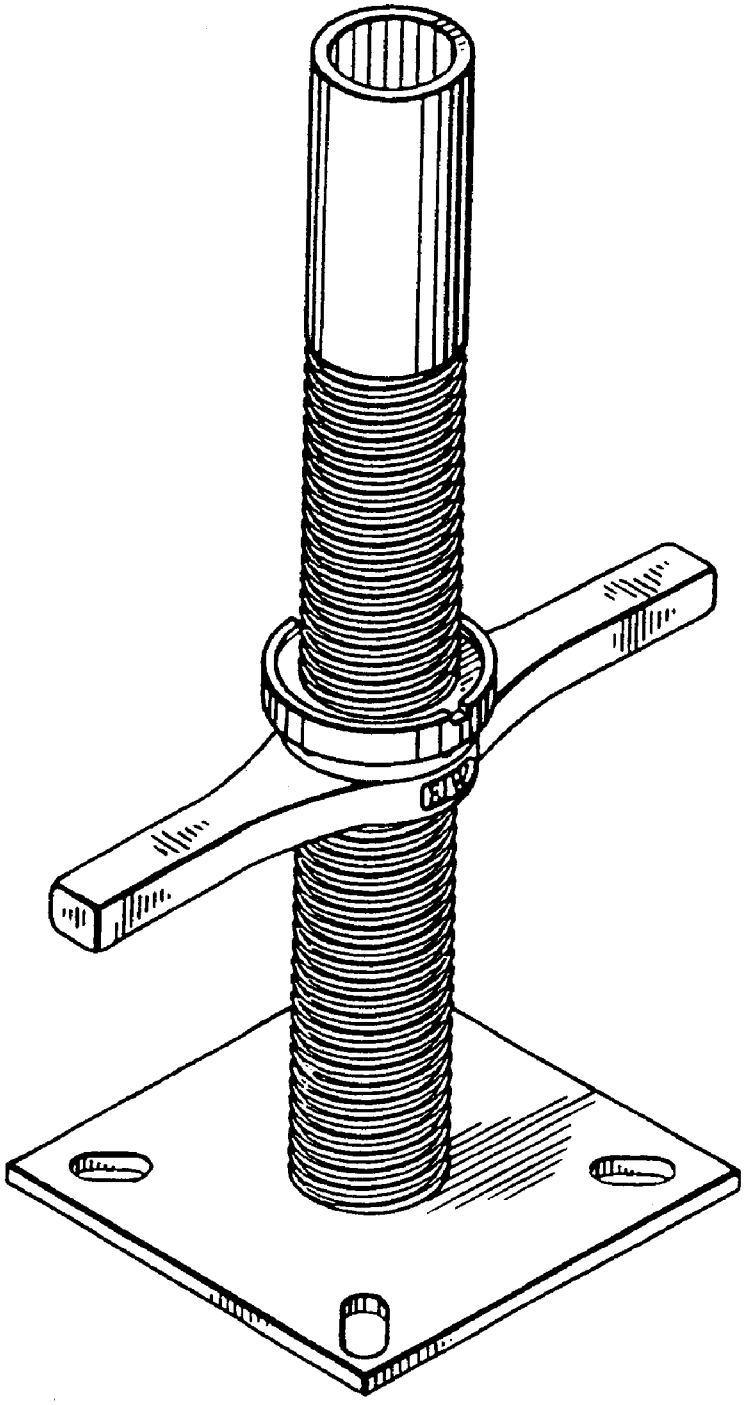

In operation extension legs 21 are inserted into the hollow tubes 17 wherefrom legs 21 are rotatably and axially slidable to desired height beyond the ends of single tube truss legs 10. Extension legs 21 have a plurality of openings 40 whereby an operator selectively locks a desired height of the extended legs 21 by inserting locking pin (not shown) through opening 19 of single tube truss legs 10; opening 40 of extension legs 21; and opening 14 of single tube legs 10. Ends of extension legs 21 are fitted into screw jack supports 35, as shown in FIG. 12, to receive and loads.

A plurality of openings are provided on several components described above to provide an increased degree of operability and effectiveness of the components in various operating conditions of the modular truss system. For instance, upper and lower chord 2,7 have a plurality of openings along surface 3. In circumstances where operating situation call for the effective height to be reduced, diagonal strut 9 is secured to the upper and lower chords 2,7 at a reduced angle of operation 11. The angle of operation 11 is the degree from the lower chord 7 to the diagonal strut 9. As the angle of operation is reduced, the effective height of the truss system is correspondingly reduced. To reduce the angle of operation 11 the operator selects an aligned opening on upper chord 2 further apart from a vertically co-linear opening on the secured lower chord 7. As a result of this novel approach to provide a greater variety of effective heights, a standard length for the diagonal strut 9 may, advantageously, be used in a variety of effective height circumstances while replacing only the single truss tubes and vertical struts. Further to this end a plurality of openings 15 are provided to lend flexibility in the effectiveness of single truss legs 10 in a variety of working conditions.

Figure 11:
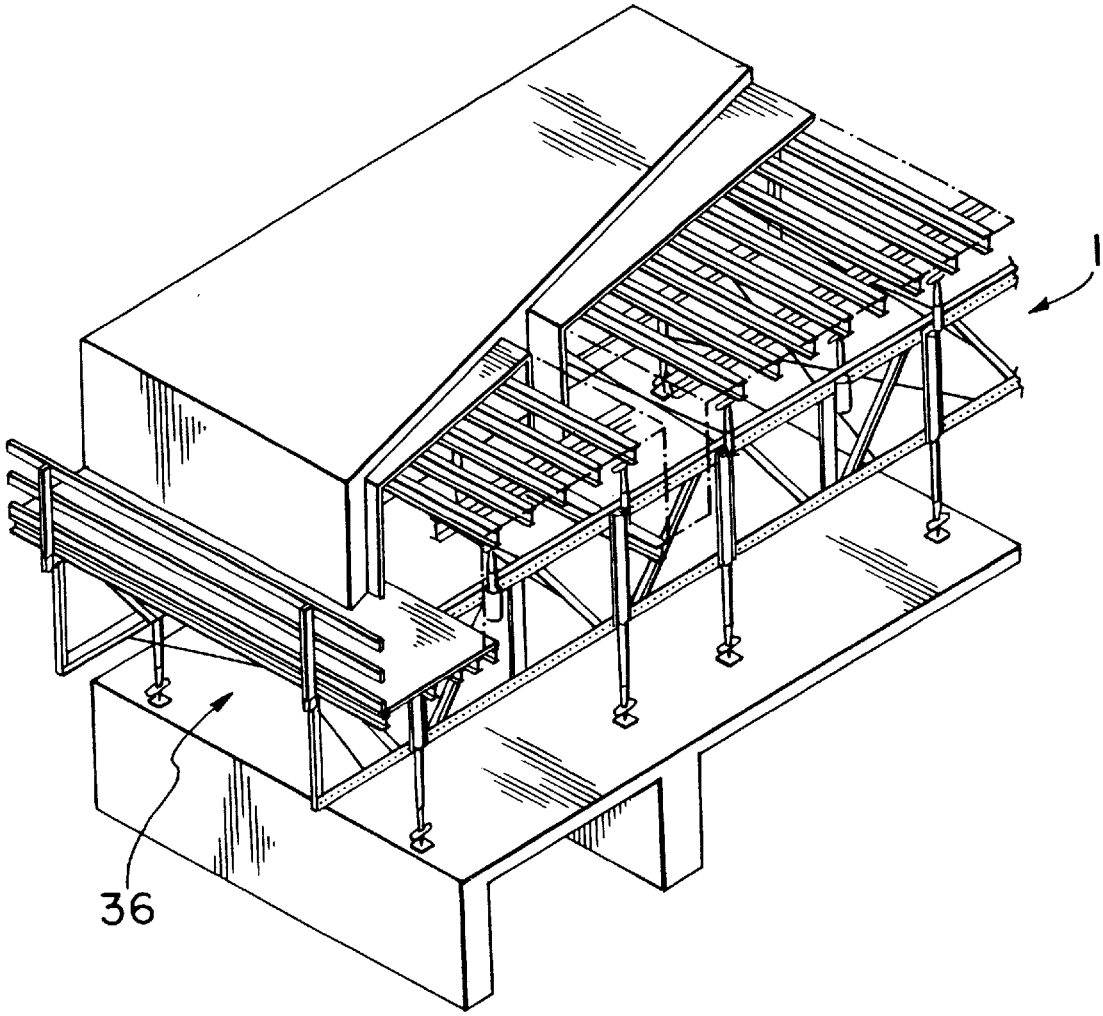
FIG. 11 is a side elevational view of a truss system module having single leg truss, diagonal strut and upper and lower chords; and, FIG. 12 is a perspective view of a hallow steel screw jack.

In operation, series of parallel truss modules described above make up the preferred embodiment. A plurality of horizontal and cross bracing members 36, as shown in FIG. 11, traverse the space between neighbouring truss modules and connect neighbouring truss modules.

Numerous modifications, variations and adaptations may be made to the particular embodiments of the invention described above without departing from the scope of the invention, which is defined in the claims. The following is an example of the many such modifications, variations and adaptations.

For instance, the diagonal strut 9 may be hinged at one end to a chord member while the other end of the strut may be connected to another chord member through a slidable connecting means. The slidable connecting means may include a guide slot in which a desired effective height may be chosen by locking the diagonal strut in a desired position along the guide slot.

Embodiments of the invention in which an exclusive property or privilege is claimed are defined as follows:

1. A modular truss shoring system having an intermediate truss structure comprising:

upper and lower chords, each said upper and lower chord having a flat horizontal surface and a flat vertical surface, each said vertical surface having a plurality of regularly spaced apertures therein;

diagonal struts each having an aperture at each end thereof, each said strut diagonally connected to the upper and lower chords at an aperture thereof, thereby determining the overall effective height of the intermediate truss structure of the system;

a plurality of tube truss legs comprising each of a single tube and a planar surface adaptively connected to the outside of the tube and extending the length of the tube, each said tube having a plurality of apertures therein, each said planar surface extending past the lateral planes of the outside wall of the tube thereby forming a mounting ledge on both sides of the tube, said mounting ledges having a plurality of apertures therein; and, extension legs inserted in each said tube and axially extendable to a desired height above or below said upper or lower chords respectively, wherein the plural number of apertures in the vertical surfaces of said chords permits said upper and lower chord to be spaced apart by more than one distance with a given diagonal strut, and permits the upwardly or downwardly extending extension legs to be added to said truss at a plurality of locations.

2. A modular truss shoring system as claimed in claim 1, further including intermediate splice angles each with a vertical and a horizontal surface, to splice together a pair of side chords.

3. A modular truss shoring system as claimed in claim 2, wherein said extension legs are axially slidable in said tubes and ends of said extension legs adaptively connect to screw jack means.

4. A modular truss shoring system as claimed in claim 2, further including splice plates emplaceable on a said chord opposite a said splice angle, thereby to sandwich an aligned pair of chords in a splice.

* * * * *